US005452669A

United States Patent [19]

Bailey

[11] Patent Number: 5,452,669

[45] Date of Patent: Sep. 26, 1995

[54] INCINERATION APPARATUS

[75] Inventor: Ian A. Bailey, Huncote, England

[73] Assignee: Richards Engineering Limited, England

[21] Appl. No.: 232,858

[22] Filed: Apr. 22, 1994

Related U.S. Application Data

[63] Continuation of Ser. No. 2,217, Jan. 8, 1993, abandoned.

[30] Foreign Application Priority Data

Jan. 8, 1992 [GB] United Kingdom ..... 9200341.7

[51] Int. Cl.[6] ..... F27D 1/06; F27D 1/00

[52] U.S. Cl. ..... 110/245; 432/14; 432/58

[58] Field of Search ..... 110/245, 235, 110/243; 432/14.58

[56] References Cited

U.S. PATENT DOCUMENTS

| | | | |
|---|---|---|---|
| 4,226,830 | 10/1980 | Davis . | |
| 4,645,452 | 2/1987 | Henin et al. . | |
| 4,693,682 | 9/1987 | Lee et al. | 110/245 |
| 4,841,884 | 6/1989 | Engstrom et al. | 110/245 |
| 5,006,062 | 4/1991 | Lee et al. | 432/14 |
| 5,020,451 | 6/1991 | Maebo et al. | 110/245 |
| 5,063,028 | 11/1991 | Humble et al. | 110/245 |
| 5,093,085 | 3/1992 | Engstrom et al. | 110/245 |
| 5,138,958 | 8/1992 | Sinquin et al. | 110/245 |
| 5,239,945 | 8/1993 | McCoy | 110/245 |
| 5,271,450 | 12/1993 | Bailey | 110/245 |

FOREIGN PATENT DOCUMENTS

| | | |
|---|---|---|
| 0248674 | 12/1967 | European Pat. Off. . |
| 180340 | 7/1988 | Japan . |
| 87106482 | 4/1986 | Sweden . |
| 323841 | 1/1930 | United Kingdom . |
| 740974 | 11/1955 | United Kingdom . |
| 2244939 | 12/1991 | United Kingdom . |
| 2244939 | 12/1991 | United Kingdom . |

*Primary Examiner*—Marguerite Macy
*Attorney, Agent, or Firm*—Basile and Hanlon

[57] ABSTRACT

Incineration apparatus for incinerating a particulate material comprises a furnace housing (2), feeding means (7) for feeding material to be incinerated into said housing (2), and gas supply means (6*a–c*) for introducing a gas into the material in a lower part of said housing (2) so as to form a fluidised bed (8). Said gas supply means (6*a–c*) is spaced from the walls of said furnace housing (2) such that said walls are insulated from the fluidised bed (8) by an insulating layer of particulate material not in a fluidised state.

22 Claims, 1 Drawing Sheet

INCINERATION APPARATUS

This application is a continuation of application Ser. No. 08/002,217, filed on Jan. 8, 1993, abandoned.

BACKGROUND TO THE INVENTION

1. Field of the Invention

This invention relates to apparatus for the incineration of granular or particulate material, in particular to apparatus for the thermal reclamation of a material such as foundry sand.

Used foundry sand may be subjected to reclamation so that it can be re-used in foundry processes. Such reclamation can take the form of mechanical attrition, whereby the sand is broken down into grain-size particles. However, used foundry sand contains a high proportion of chemical bonding agents, eg phenolic resins, and after a while these agents reach such a level that the properties of the sand deteriorate, even with mechanical reclamation. Consequently, there is a need for a thermal reclamation technique whereby the chemical agents are incinerated, leaving relatively clean sand. Such thermal reclamation is typically conducted in a furnace having a fluidised bed.

In a fluidised bed furnace, material to be treated is fed in and incinerated, the waste gases escaping through a flue stack at the top of the furnace. The reclaimed material is removed either periodically or continuously. The reaction may be substantially self-sustaining. That is to say, in theory at least, once the combustion process has reached a steady state from start-up (typically at around 800° C.), there is no need to supply significant amounts of fuel gas since the combustion is supported by burning of the chemical agents.

2. Description of the Prior Art

Since furnaces of this type are subjected to considerable variations in temperature, yet must be completely air-tight in the fluidised zone, considerable problems are encountered with cracking or even collapse due to thermal expansion. Hitherto, attempts have been made to overcome these problems by constructing the walls of the furnace of specially shaped refractory concrete. Alternatively, the fluidised bed has been enclosed in a stainless steel tank, which may be corrugated, having an external jacket of insulating material, such as ceramic fibre, with minimal thermal expansivity, the remainder of the furnace comprising a steel casing also lined with ceramic fibre.

Furnace designs of this kind suffer from a number of disadvantages. They are, for example, relatively complex and costly to manufacture. In addition, maintenance is difficult and costly to carry out.

There has now been devised an incineration furnace including a fluidised bed which overcomes or substantially mitigates the above-mentioned problems.

BRIEF SUMMARY OF THE INVENTION

According to the invention, there is provided incineration apparatus for incinerating a particulate material, the apparatus comprising a furnace housing, feeding means for feeding material to be incinerated into said housing, and gas supply means for introducing a gas into the material in a lower part of said housing so as to form a fluidised bed, said gas supply means being spaced from the walls of said furnace housing such that said walls are insulated from the fluidised bed by an insulating layer of particulate material not in a fluidised state.

The apparatus according to the invention is advantageous primarily in that it is of relatively simple, and hence inexpensive construction. There is no requirement for the use of a stainless steel tank or refractory concrete to contain the fluidised bed. There are also relatively few components in the overall structure and very few components which are subject to any requirement for maintenance.

DETAILED DESCRIPTION OF THE INVENTION

The apparatus according to the invention may be used for the incineration of a wide range of particulate materials, but is of particular utility in the thermal reclamation of a base material from a mixture of that material with a combustible substance. One example of such a base material is foundry sand. Another material which may be incinerated using the apparatus according to the invention is dewatered sewage.

The gas supply means preferably comprises a suitable arrangement of pipes fitted with, for example, nozzles or bubble caps.

Generally, the spacing between the gas supply means (eg the nozzles) and the walls of the furnace housing should be sufficient to ensure adequate insulation of the walls from the fluidised bed. The required spacing will depend on, for example, the depth of the fluidised bed and the nature of the particulate material forming the insulating layer between the fluidised bed and the walls.

The fluidised bed may be formed wholly of the material being incinerated, or of a separate medium, eg sand. Similarly, the material forming the insulating layer may be material to be incinerated or some other particulate material.

The furnace housing is preferably of mild steel, and is preferably lined with a material of minimal thermal expansivity. One such suitable material is ceramic fibre which may be secured to the walls of the housing by conventional means. The insulating lining may include an impervious membrane, eg a stainless steel foil, to prevent combustion products condensing on the internal surface of the furnace housing.

In the lower part of the furnace housing, a barrier is preferably interposed between the ceramic fibre lining and the insulating layer of granular material to prevent penetration of that material into the ceramic fibre. The barrier may be, for example, a vacuum-formed ceramic fibre board.

The material to be incinerated may be fed directly into the lower part of the fluidised bed as described in our copending UK patent application no 2244939A, in which case the material may be fed into the fluidised bed from below the latter. Alternatively, the material may be fed onto the bed from above by conventional means.

Conveniently, the material is fed to a confined space beneath the fluidised bed by means of a mechanical conveyor. Alternatively, the material can be fed to the fluidised bed by a pneumatic conveyor, and is preferably injected into the bed at substantially the same level as the fluidising gas.

In cases where the material is fed to the fluidised bed in batches, a plurality of feeds is preferably provided which operate in sequence. For example, where two such feeds are provided, these can operate alternately.

Advantageously, the feeding means includes a plurality of pneumatic conveyors each of which feeds the material to the fluidised bed in batches, and means to operate the pneumatic conveyors in sequence.

DETAILED DESCRIPTION OF PREFERRED EMBODIMENT

Figure 1:
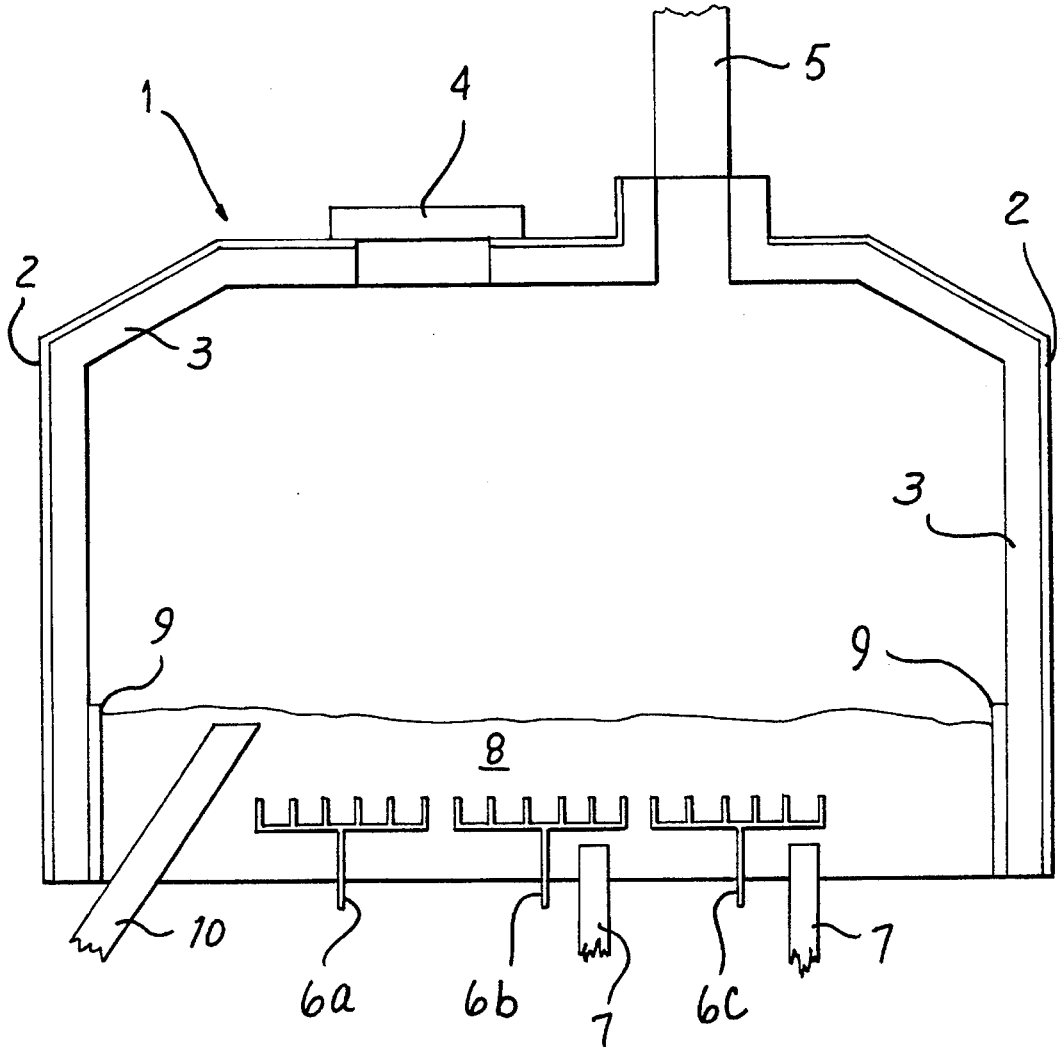
FIG. 1 shows a sectional side view of a thermal reclamation apparatus according to the invention.

Referring to FIG. 1, a thermal reclamation apparatus (generally designated 1) according to the invention comprises a generally bell-shaped furnace housing 2 of mild steel. The furnace housing 2 is lined with a layer 3 of closely packed ceramic fibre which is secured to the housing 2 by hooks and skewers (not shown) in a conventional manner. At the top of the housing 2 there are provided an access door 4 for maintenance and a stack 5 through which flue gases can escape.

Within the lower region of the housing 2, and inwardly spaced therefrom, there are provided three air/gas manifolds 6*a–c* of conventional form, comprising pipes fitted with bubble caps. Material to be reclaimed is introduced from below through pneumatic conveyer pipes 7 and forms a bed 8 at the base of the apparatus. A layer of vacuum-formed ceramic fibre board 9 is provided around the lower portion of the ceramic fibre lining 3 to prevent penetration of the material into the lining 3.

Air/gas introduced through the manifolds 6*a–c* fluidises the bed 8, except in the regions shown by cross-hatching. These latter regions act as an insulating layer between the fluidised bed 8 and the housing 2.

An exit chute 10 is located towards the left as shown in FIG. 1 with its opening a short distance below the level of the bed 8.

In use, material to be reclaimed (such as a comminuted mixture of foundry sand and phenolic resin bonding agent) is fed from, for example, a silo or hopper (not shown), and introduced into the bed 8 via the conveyor tubes 7. The material thus enters the fluidised bed 8 from below, through the interstices between the bubble caps of the manifolds 6*a–c*. There is a net transport of material from right to left, material being introduced at the right and passing out of the furnace through the exit chute 10 at the left.

I claim:

1. An incineration apparatus for incinerating a particulate material, the apparatus comprising:

a furnace housing having side walls;

means for feeding said particulate material to be incinerated into a lower part of said housing; and gas supply means for introducing a gas into a central region of said particulate material to form a centrally located active fluidized bed region and an outer, inactive non-fluidized bed region wherein a distance from said furnace side walls to said gas supply means is greater than a distance from said gas supply means to a top of said active fluidized bed region and said outer, inactive non-fluidized bed region surrounding and contacting said active fluidized bed region and insulating said side walls of said furnace housing from said fluidized activity of said centrally located active fluidized bed region to prolong the life of said furnace side walls.

2. The incineration apparatus as claimed in claim 1, wherein said gas supply means comprises an arrangement of pipes fitted with nozzles.

3. The incineration apparatus as claimed in claim 1, wherein the spacing between said gas supply means and said walls of said furnace housing is sufficient to ensure thermal insulation of said walls from the fluidised bed.

4. The incineration apparatus as claimed in claim 1, wherein the fluidised bed is formed wholly of material being incinerated.

5. The incineration apparatus as claimed in claim 1, wherein the fluidised bed is formed of a separate medium from the material being incinerated.

6. The incineration apparatus as claimed in claim 1, wherein the material forming said insulating layer is material to be incinerated.

7. The incineration apparatus as claimed in claim 1, wherein said furnace housing is of mild steel.

8. The incineration apparatus as claimed in claim 1, wherein said furnace housing has a lining of material of minimal thermal expansivity.

9. The incineration apparatus as claimed in claim 8, wherein said lining comprises ceramic fiber.

10. The incineration apparatus as claimed in claim 8, wherein said lining includes an impervious membrane to prevent combustion products condensing on an internal surface of said furnace housing.

11. The incineration apparatus as claimed in claim 10, wherein said membrane is a stainless steel foil.

12. The incineration apparatus as claimed in claim 8, wherein a barrier is interposed between said lining and said insulating layer of particulate material to prevent penetration of the insulating material into said lining.

13. The incineration apparatus as claimed in claim 8, wherein a vacuum-formed ceramic fibre board is interposed between said lining and said insulating layer of particulate material to prevent penetration of that material into said lining.

14. The incineration apparatus as claimed in claim 1, wherein material to be incinerated is fed directly into a lower part of the fluidised bed.

15. The incineration apparatus as claimed in claim 14, wherein the material to be incinerated is fed to a confined space beneath the fluidised bed by means of a mechanical conveyor.

16. The incineration apparatus as claimed in claim 14, wherein the material to be incinerated is fed to the fluidised bed by means of a pneumatic conveyor, and is injected into the bed at substantially the same level as the gas.

17. The incineration apparatus as claimed in claim 1, wherein material to be incinerated is fed to the fluidised bed in batches, a plurality of feeds being provided which operate in sequence.

18. The incineration apparatus as claimed in claim 1, wherein said feeding means includes a plurality of pneumatic conveyors each of which feeds material to be incinerated to the fluidised bed in batches, and means to operate the pneumatic conveyors in sequence.

19. An incineration apparatus for incinerating a particulate material, the apparatus comprising:

a furnace housing having vertical side walls fabricated from a mild steel;

a ceramic fiber lining the interior of said side walls of said furnace housing;

means for feeding said particulate material into a lower part of said furnace housing to form a bed of said particulate material extending across substantially all of said lower part of said furnace housing; and means for supplying gas into a central region of said bed of said particulate material to form an active fluidized bed region centrally located in said furnace housing wherein a horizontal distance from said vertical furnace side walls to said gas supply means is greater than a vertical distance from said gas supply means to a top of said active fluidized bed region and wherein an inactive non-fluidized bed region of said particulate material is formed and surrounds and contacts said active fluidized bed region of said particulate material thus insulating said interior walls of said furnace housing from fluidized activity of said active fluidized bed region of said particulate material to prolong the life of said furnace walls.

20. An incineration apparatus for incinerating a particulate material, the apparatus comprising:

a furnace housing having vertically extending side walls;

at least one conveyor pipe opening into a lower portion of said furnace housing for feeding particulate material into said lower portion of said furnace housing to form a bed of said particulate material extending across substantially all of said lower portion of said furnace housing; and means for supplying gas into a central region of said bed of said particulate material to form an active fluidized bed region centrally located in said furnace housing wherein a horizontal distance from said vertical side walls to said gas supply means is greater than a vertical distance from said gas supply means to a top of said active fluidized bed region and wherein an inactive non-fluidized bed region of said particulate material is formed to insulate said interior walls of said furnace housing from fluidized activity of said active fluidized bed region to prolong the life of said furnace walls.

21. The incineration apparatus as stated in claim 20, the apparatus further comprising:

at least one exit pipe extending through said lower portion of said furnace housing and opening at an upper level of said active fluidized bed region for removing said incinerated particulate material.

22. An incineration apparatus for incinerating a particulate material, wherein said apparatus has a furnace housing with furnace walls, means for feeding particulate material into said furnace housing, and means for supplying gas into said furnace housing to fluidize said particulate material, wherein the improvement comprises:

said gas supply means being spaced a sufficient distance from said furnace walls to form an active fluidized bed region centrally located in said furnace housing wherein a horizontal distance from said furnace walls to said gas supply means is greater than a vertical distance from said gas supply means to a top of said active fluidized bed region, wherein an inactive, non-fluidized bed region surrounding and contacting said active fluidized bed region is formed to insulate said interior walls of said furnace housing from said fluidized activity of said active fluidized bed region to prolong the life of said furnace walls.

* * * * *